US005720568A

United States Patent [19]

Kairi

[11] Patent Number: 5,720,568

[45] Date of Patent: Feb. 24, 1998

[54] PREFABRICATED JOINT STRUCTURE FOR A WOODEN BEAM

[75] Inventor: Matti Kairi, Lohja, Finland

[73] Assignee: Finnforest Oy, Lohja, Finland

[21] Appl. No.: 509,897

[22] Filed: Aug. 1, 1995

[30] Foreign Application Priority Data

Aug. 2, 1994 [FI] Finland ..... 943600

[51] Int. Cl.[6] ..... F16B 15/00

[52] U.S. Cl. ..... 403/405.1; 403/12; 403/14; 52/639; 411/461

[58] Field of Search ..... 403/405.1, 283, 403/187, 188, 393, 384, 12, 13, 14; 411/457–475; 52/642, 639, DIG. 6

[56] References Cited

U.S. PATENT DOCUMENTS

| | | | |
|---|---|---|---|
| 2,099,273 | 11/1937 | Myer | 411/460 X |
| 2,283,943 | 5/1942 | Myer . | |
| 2,385,142 | 9/1945 | Lank | 52/639 |
| 2,391,061 | 12/1945 | Mackintosh | 403/281 |
| 3,449,997 | 6/1969 | Couch | 411/466 |
| 3,535,845 | 10/1970 | Troutner | 52/639 |
| 3,985,459 | 10/1976 | Gilb | 52/639 X |
| 4,312,160 | 1/1982 | Wilbanks | 52/639 X |
| 4,649,688 | 3/1987 | Mosier . | |

FOREIGN PATENT DOCUMENTS

| | | | |
|---|---|---|---|
| 492177 | 4/1953 | Canada | 411/457 |
| 634108 | 1/1962 | Canada | 52/642 |
| 1445503 | 6/1966 | France . | |
| 706507 | 4/1941 | Germany . | |
| 852153 | 7/1952 | Germany . | |
| 852443 | 8/1952 | Germany . | |
| 257965 | 11/1948 | Switzerland . | |
| 314864 | 8/1956 | Switzerland | 403/405.1 |
| 128555 | of 0000 | United Kingdom | 411/401 |

OTHER PUBLICATIONS

Prefabrication, Back Cover, Dec. 1953.

*Primary Examiner*—Harry C. Kim

*Attorney, Agent, or Firm*—Klarquist Sparkman Campbell Leigh & Whinston, LLp

[57] ABSTRACT

The invention relates to a prefabricated joint structure for joining an essentially wooden elongated beam (2) or similar to at least one other beam (2) over a predetermined length (A) of a relatively short joint portion (4) in the beam, the joint (1) being accomplished by pins, bolts or the like (5) penetrating the beam or beams. In each joint there are at least two jointing in a direction transverse to the main gain of the beam. The joint structure further comprises a metal nail plate (6), having a plate plane transverse to the length (T) of the jointing and whose nails (7) protrude from the plate plane and are embedded in the beam wood. On the prefabricated joint portion (4) in each beam (2), at least one single-sided nail plate (6) has been fitted against the outer surface of the beam, the width (W1) of the plate plane of the nail plates in a direction perpendicular to the main beam grain (D) being greater than the distance (W2) between the holes (15) for the two jointing (5) in this direction, and the nails (7) of the nail plates (6) being embedded in the wood nearly parallel to the jointing holes. The holes (15) in the jointing perforate the beams (2) in the area of the plate planes of the nail plates, and they have been formed both in the nail plate (6) and in the beam (2) after the nail plates have been fixed to the beam by pressing, in order to provide joint portions (4) retaining dimensional accuracy irrespective of external influences and apt for later assembly into joints (1).

6 Claims, 6 Drawing Sheets

PREFABRICATED JOINT STRUCTURE FOR A WOODEN BEAM

FIELD OF THE INVENTION

The invention relates to a prefabricated joint structure for connecting a principally wooden beam or the like with at least one other beam and/or other construction over a predetermined overlapping joint portion of the beam or beams which is essentially shorter than the beam length, the joint being realised by means of pins, bolts or similar jointing means penetrating the joint portion, there being at least two such jointing means in each joint in a direction transverse to the main grain of the beam, the beams comprising, besides an elongated, essentially wooden load-carrying component, a metal nail plate, whose plate plane is transverse to the length of the jointing means, and thus to its direction of compression, and whose nails protrude from the plate plane and are embedded in the beam wood.

TECHNICAL BACKGROUND

When a prefabricated joint structure of mainly wooden beams or similar components are being aimed at, in which the elements of the final beam joint, i.e. the joint elements, have been preworked, and whose joint elements are later readily assembled into a finished joint, the jointing means usually consist of bolts, pins or similar. Thus, in the processing of the beams, holes are perforated in the joint portions, and as the parts are assembled, bolts or pins are pushed through these holes and serve to interconnect the beams to form the final construction. The manufacturing techniques as such are straightforward and inexpensive, and are thus particularly suitable for small-sized constructions which are not subject to strict requirements in terms of dimensional accuracy, rigidity or strength, whereby the holes may have a considerably larger diameter than that of the jointing means used, such as a bolt. In this case, there are no problems with regard to assembly. However, if the joints are intended to be accurate and to carry appreciable loads, this construction method is inappropriate, since over-sized holes weaken the construction and fail to produce a regular load distribution in the beam.

Joints for wooden beams intended to carry heavy loads are usually accomplished by nailing or bolting or pins, gaining their final shape directly, and in that case prefabrication is not possible. On the other hand, prefabrication is very impractical for many purposes of use, given that preassembled constructions may be bulky and awkward to transport, and what is more, assembling in situ may be complicated due to deficient devices and working space, and may result in a joint of poor quality. When joints are realised by means of nail plates as described for instance in U.S. Pat. No. 3,498,170, U.S. Pat. No. 4,891,927 or U.S. Pat. No. 5,006,006, wooden beam joints have a very high joining effect, since the nail plates distribute the loads over a wide area in the beams. Yet nail plate joints have the same drawbacks in other respects as the final joints described above, and the nail plates described do not enable prefabricated, easy to assemble elements, since each nail plate must extend over the interface of at least two beams to be interconnected. U.S. Pat. No. 3,454,292 describes a nail plate design, in which, to each of the two wooden beams to be interconnected, first a specific joining plate is appropriately attached, and then the nails in one of the joining plates are pressed into the openings in the second joining plate as the beams are being joined, and thus the joining plates and also the beams are interlocked. In a design of this type, assembling the joint requires great forces for pressing the beams together and perfect positioning accuracy, and it is thus inappropriate for prefabrication and assembly in situ. A second reason for which this design is inappropriate for prefabrication is that the prefixed nails in the joining plates protrude from the beam, and would thus be damaged during transportation and prevent assembly of the joint, or would be harmful to the environment. The joining method described above entails all the drawbacks of the nail plate joints described above.

A simple bolt joint, comprising a nail plate as a base plate locking the directions of the joint beams, has been depicted in CH patent U.S. Pat. No. 216,619. In this specification, the nails of the base plate are embedded in the beam wood in order to retain the base plate in place, and for the base plates to retain the beams in the directions set for them. The joint elements can be prefabricated and the final joint is very easy to assemble. However, this construction is unable to carry great forces, since it contains only one bolt, and the force transmitted from the bolt is not distributed over a beam area that is large enough. In fact, this specification does not aim at great strength, but at easy directing of the beams.

U.S. Pat. No. 3,605,360 and U.S. Pat. No. 4,097,162 describe wooden beams, in which the essential element is an interior part extending over the entire length of the beam and consisting of one or more nail plates. Thus, they actually do not at all concern mainly wooden beams, but a metal/wood composite. In U.S. Pat. No. 4,097,162 the beam is held together by the nails in parallel, double-faced nail plate strips placed in the middle of the beam, the nails being embedded in the two opposite wooden parts forming the beam surfaces. In U.S. Pat. No. 3,605,360 the beam construction may be the same as in the former specification, or optionally several metal plates may be used in the middle of the beam and the unit may be assembled into a beam by means of nails or penetrating screws. In this case nail plates are not being used. In U.S. Pat. No. 4,097,162 the metal strips in the middle of the beam are also utilised to achieve a joint between two beams with bolts or pins used as jointing means. In order to achieve a joint portion, the metal strips are allowed to extend beyond the end of one beam and through-openings matching the cross-section of the metal strips are perforated in the wood of the second beam. Positioning holes are made in the nail plates and apparently also in the wooden portion of the beams. As the final joint is being assembled, the metal strips are inserted into these openings of the second beam, with nail plate planes parallel, and the beams are locked with bolts or pins perpendicular to the nail plate planes and penetrating mutually positioned holes. The joint design suggested here is apt for prefabrication and for assembly in situ, given that mounting operations merely involve simple and easy bolt and pin joints. The use of nail plates will distribute the load over a fairly large area, so that the joints probably resist relatively heavy loads. However, the fact that the cross-surface of the joint is equal to that of an individual beam, i.e. the beam thickness is reduced in the joint area, reduces the strength of the joint. Another notable drawback is that one has to know the type and location of each joint before the assembly of the individual beams because of the opening to be perforated through the centre of the beam. This means that beams cannot be manufactured in advance to be stored as metric goods, but merely as individual beam units devised for the final product. A third crucial drawback is that variations in the surrounding air humidity, and/or the wooden portion of the beam drying or being moisturised for other reasons, will result in the joint being impossible or at least very difficult to assemble later on the mounting site. This is due to the fact that moisture variations in wood entail dimensional variations, so that the distances between the bolts and pins in the joint of the reference will change to various degrees and in various directions, the bolts and pins then being unable to be mutually positioned.

Thus the purpose of the invention is to achieve a joint design to be carried out in mainly wooden beams and similar bodies, which can be prefabricated in a form that can be easily assembled into the final joint on the mounting site without special equipment. The purpose is specifically a joint design, which is finally assembled on the mounting site by means of a bolt, pin or screw fastener, and to this end, appropriate holes have been made in advance in the joint portions of the wooden beams or the like, i.e. the beam portion at the respective joint, the holes being positioned with regard to holes or pins or similar in the second joint element. In the joint design of the invention, at least the first joint component is a wooden beam or the like, whereas the second component may be a matching wooden beam or any solid construction or other element, to which the first component is connected. A second purpose of the invention is to provide a prefabricated joint design, which has a very, high joining effect, i.e. great strength and/or stiffness compared to the strength of the components in the joint. In this conjunction, the term joining effect is used to denote the force which the wood resists over each beam area required for the joint. The maximum value would be the strength of entire wood. Especially to achieve a high joining effect, the joint must contain at least two bolts, pins or the like penetrating essentially the entire finished joint, and the load transmitted by the bolts to the beam must be efficiently distributed over a large area in the beam. High-strength joints typically comprise several bolts, pins or the like spaced at least by the transverse distances of the beam and often also by the longitudinal distances of the beam. The third specific purpose of the invention is thus to provide a prefabricated joint design, in which the mutual position of the holes for the fixing means in the beam, i.e. the holes for the fixing means relating to one joint, is maintained very exactly the same in all directions regardless of variations in the circumstances, such as wood moisture, thus always allowing exact assembly and positioning of the holes with regard to the other holes or fixing pins, screws or the like. The mutual position of the holes must remain so exact that the hole diametres may be made exactly equal to the diametres of the bolts or pins used, and thus a higher joining effect will be achieved. The fourth specific purpose of the invention is a joint design, in which the load transmitted through the bolts, pins or similar jointing means is distributed around each jointing means both evenly and over such a large area in the surrounding beam that is considered necessary in each case. The fifth purpose of the invention is to provide a prefabricated joint design, which is applicable in every case, the starting material being any prefabricated, mainly wooden beam-like material. Thus the joint design must be such that there is no need to take future joints into account when the beam material is being produced, but the beams may be manufactured to be stored as standard qualities, and the joint constructions may be later prefabricated at any point of the beam length depending on the final product. The joint design must also be such as to be usable as a joint for beams of massive wood or full wood. The sixth purpose of the invention is to provide a joint design, which is simple to manufacture and inexpensive compared to conventional simple beam joints.

SUMMARY OF THE INVENTION

The drawbacks described above are eliminated and the purposes set out above are achieved with the prefabricated joint design of the invention.

The main advantage of the invention is that it serves to prevent deformations and dimensional variations in the wood over the joint portion relative to each joint, so that the joints may be prefabricated with small tolerances for instance at a factory, and the joint can be rapidly and easily assembled on the mounting site. A further advantage of the invention is that the final joint is extremely strong, rigid and has a high joining effect, thus enabling the number of bolts, pins or similar to be reduced compared to conventional bolt or pin joints. The high joining effect of the joint of the invention further enables the cross-dimension of the beam material used in the construction to be reduced compared to constructions using conventional bolt or pin joints, because the joining effect of the joint design of the invention is of the order of 80–90% of the maximum value, whereas conventional bolt or pin joints yield a joining effect of approx. 60% at the most. These features achieve a simple and inexpensive joint design and entire construction. Still a further advantage of the invention is that the inventive joint design is applicable to quite different mainly wooden beam-like components, no special requirements being imposed in terms of the invention on the beam material or interior structure of the beam, so that these can be devised with other criteria.

The invention will be described below with reference to the enclosed drawings.

DETAILED DESCRIPTION OF PREFERRED EMBODIMENTS

The following detailed description of the various embodiments of the invention will use the same references for the same or corresponding joint elements.

The invention relates to connecting at least one mainly wooden beam 2 either to a second beam 2 and/or to another structure 8, 9. In this connection, a mainly wooden beam 2 and a wooden beam 2 denote an elongated body formed either directly by sawing or in some other manner out of the trunk or formed by gluing ribs or thinner or thicker veneers to form an essentially wooden beam or bar, or in some cases a plate-like elongated body. The mainly wooden beam described above has a main grain D and a direction perpendicular to this. The beam properties are thus brought about by the glue connecting the mainly wooden and to some extent wooden elements, but not to any notably extent by any metal element in the beam. The beam as such may of course contain metal elements, such as nails and staples or similar, used to facilitate the beam assembly by gluing, however, these have no significant impact on the finally implemented shape of the beam. Besides the massive beam described above, a typical beam in the inventive joint design is a lamellar wood structure, a batten, or a beam consisting of partly cross-wise glued veneers, provided that the main gains in most of the veneers of this last beam, estimated on the cross-surface of the veneers, are nearly parallel, forming a main gain D. Such a structure has been described for instance in the earlier patent application EP 92117981.8, in which the veneers form a gain combination with an average or a main gain. In all such beams, the main gain D nearly always joins essentially the longitudinal direction L of the beam, both for process-technical and strength reasons. There may of course be minor deviations, but generally the longitudinal direction and the main grain may be considered identical with sufficient accuracy. The length of the beam is usually at least the double of any transverse dimension of the beam, but usually considerably greater, such as five times, ten times or more.

Figure 11:
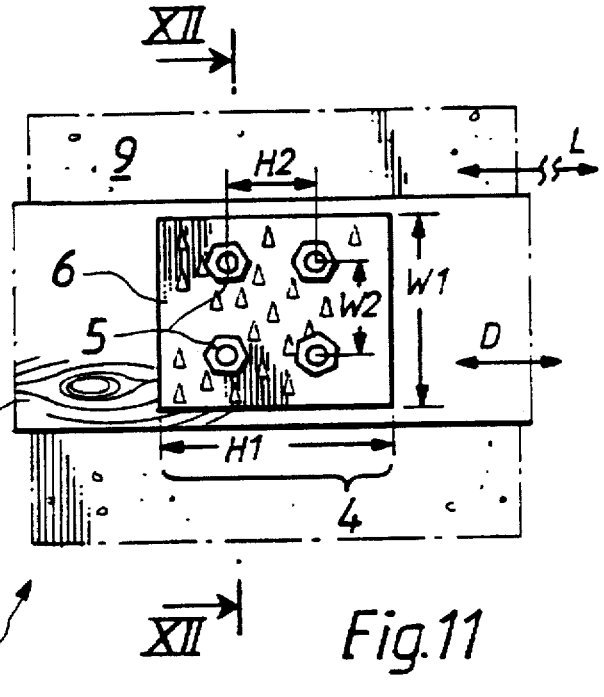
FIG. 11 shows a finished joint to a solid other component, the joint having been achieved by means of the fifth embodiment oft he joint design of the invention, viewed in the beam plane in direction XI of FIG. 12.

Such a wooden beam is connected to another beam 2 or any other structure 8, 9 over the length A of the joint portion 4 of the joint 1, whereby joint portion usually stands for the area over which the components to be connected are in mutual contact at their surfaces. Thus, for instance in scarf joints and angular joints, the joint portion 4 consists of the contact area between these beams or of a common projection area and its dimension in direction L of the beam. The length A of the joint portion 4 in a scarf joint is unambiguously the length of the contact area between the beams in the longitudinal direction L of the beams, and an angular beam joint comprises two lengths A of the joint portion, one of which extends in the longitudinal direction of the one beam and the other in the longitudinal direction of the second beam, as illustrated in the figure. In some rare cases, in which the wooden beam 2 is connected to a solid object 9, the contact area may be greater than the actual joint portion 4. In such cases the length H1 in the longitudinal beam direction L of the nail plate forming a component in the joint is regarded as the length A of the joint portion 4, as shown in FIG. 11. As stated above in the definition of the wooden beam, the nail, or fastener plate 6 in the beam does not extend over the entire length of the beam 2, but only relates to the accomplishement of the joint 1, as will be described below.

When the joint prefabricated in accordance with the invention is being used in a mainly wooden beam 2, this beam is attached at its joint portion 4 forming the joint construction by means of pins, bolts or similarjointing means 5 penetrating the beam, which are inserted on the mounting site through holes 15 made in advance in the area of the joint portion and are clamped in place, thus providing the finished beam joint 1. There are at least two jointing means 5 and matching holes 15 for each joint 1 on the joint portion of the beam 2. These at least two jointing means 5 are spaced by a distance W2 in a direction transverse to the main gain D of the beam. The joint design of the invention is assembled into the final joint on the mounting site by positioning the beam holes 15 in the joint portion 4 of the joint either with regard to the holes 15 in the second beam of the joint 1 or to optional solid jointing means 5 in another construction 8 or 9, after which the actual connecting is carried out by means of these jointing means 5. The jointing means 5 may be ordinary bolts provided with nuts or pins to be tightly fired into the beam holes 15 or any barlike means suitable for this purpose, which may be fixed into these holes. If there are more than two jointing means 5 for the joint 1, the jointing means are advantageously disposed in rows transverse to the beam, being then also in rows nearly transverse to the main gain D of the beam 2. The jointing means have been arranged in this way in the embodiments of FIG. 3, FIGS. 4–6, FIGS. 7–8 and FIGS. 11–12.

Figure 3:
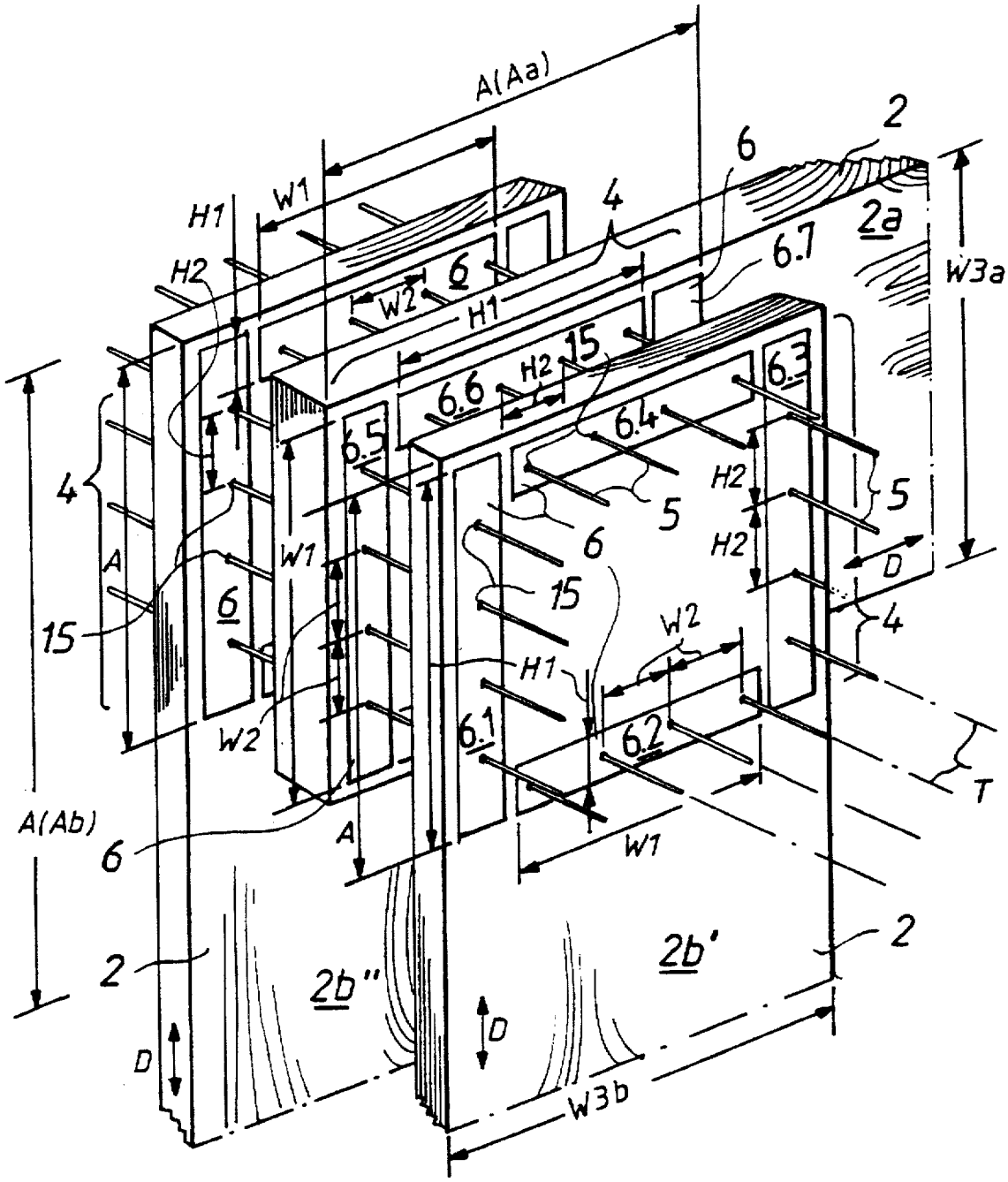
FIG. 3 shows a second angular joint, achieved by means of a second embodiment of the joint design of the invention, as an axonometric exploded view.
Figure 7:
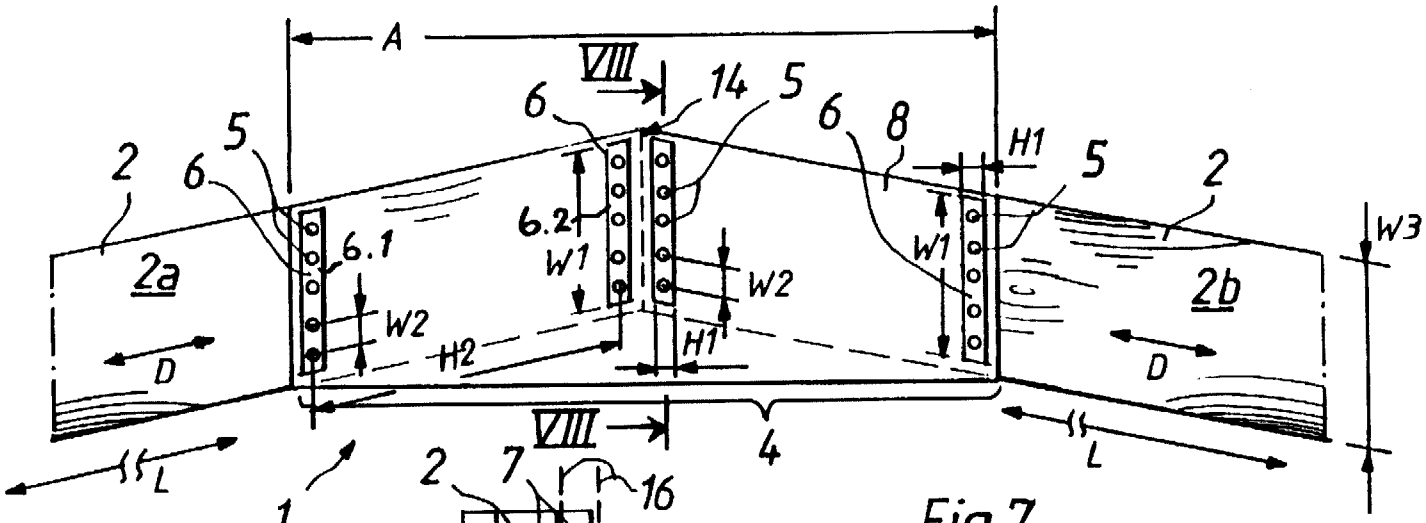
FIG. 7 shows a third finished angular joint, obtained by means of the said third embodiment of the joint design of the invention, viewed in the beam plane in direction VII of FIG. 8.
Figure 8:
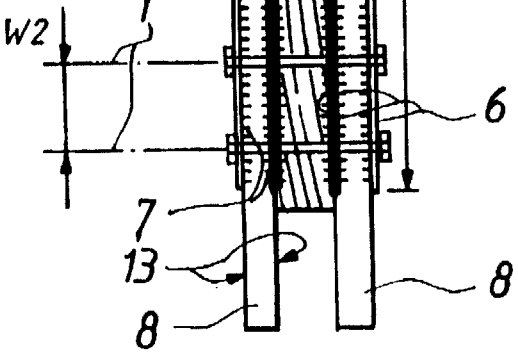
FIG. 8 shows the angular joint of FIG. 7 as a cross-section along plane VIII—VIII of FIG. 7 on a larger scale.

The inventive joint involved by the components described above comprises at least one metal nail plate 6 in each beam 2 included in the joint 1, on the joint portion 4 of the beam. The plate plane 16 of each nail plate 6 is transverse and typically perpendicular to the length T of the jointing means 5, and the nails 7 of the nail plate protrude from the plate plane 16 and are embedded in the beam wood at least nearly parallel to the holes 15 in the jointing means. The nail plates 6 used in the prefabricated joint of the invention are single-sided nail plates, placed against the outer surface 12 of the beam. The width W1 of the plate plane 16 of this nail plate 6 in a direction perpendicular to the main gain D of the beam is greater and preferably substantially greater than the distance W2 between the holes 15 in the two jointing means mentioned above. As shown in the figure, this means that the holes in the two jointing means 5, spaced by the distance W2 in a direction transverse to the beam gain D, are always formed in the same nail plate 6. Thus the width W1 of the nail plate must exceed the distance W2 between the holes to such an extent that a sufficient portion of the bolt head remains beyond the holes 15 to support and distribute the load. In case there are more than two jointing means 5 as mentioned above on the joint portion in the direction transverse to the main gain D, the width W1 of the nail plate is then, in accordance with the invention, preferably greater than the sum of the distances W2 of the jointing means in the said transverse direction, all the holes 15 in the jointing means being in this direction in the same nail plate. Such a design and dimensioning are illustrated in FIGS. 3, 7 and 8. It is possible, within the scope of the invention, to distribute the number of jointing means in a direction transverse to the gain D over several nail plates, each being required to meet the condition defined above and to contain all the jointing means in this direction. If, for instance there are three jointing means and respective holes in this direction, two nail plates should be used, which should at least overlap to keep the dimensional variation low in a direction transverse to the grain. Specifically, in accordance with the invention, these holes 15 have been perforated in the nail plates 6 and in the area of the plate plane 16 of the nail plates in the beam 2 after the nail plate 6 or the opposed nail plates 6 have been fixed to the beam by pressing. The holes 15 are thus formed through the complex formed by the wooden beam and the nail plate pressed into this, while the joint portion has been fixed for instance to a jig at the factory, or the joint has been preassembled at the factory. The beams having been provided with the joint of the invention are subsequently conveyed, perforated with holes 15 for the jointing means, from the prefabrication site to the mounting site, where only assembly is normally carried out.

The joint design described above yields the surprising effect that the distances W2 between the holes 15 made in advance in the joint portion 4 and the optional distances H2 retain their original dimensions with extreme accuracy in all directions and especially in the transverse direction of the beam, i.e. a direction transverse to the main grain, irrespective of variations in the surrounding circumstances, which would normally cause such substantial dimensional variations in a mainly wooden beam that a prefabricated joint construction could no longer be assembled into a finished joint. This effect of the inventive joint is so understood that the nail plate 6 or the nail plates 6 prevent any dimensional variations in the area of the joint portion 4. In fact, dimensional variations in a wooden beam made in one piece are greatest in a direction corresponding to the circumferential direction of the original trunk and distinctly smaller in the radial direction, and essentially smaller in the longitudinal direction of the trunk than in the radial direction. In lamellar wood structures, diagonal lameliar wood structures and beams formed of partly cross-wise glued veneers, no circumferential or radial deformation can be distinguished, however, on the average, dimensional variations in these are appreciably greater in directions transverse to the beam length than in the longitudinal direction. Consequently, the joint design of the invention eliminates these problems caused by dimensional variations in a simple manner. Since dimensional variations are practically completely eliminated by the prefabricated joint of the invention, the diameters of the holes 15 for the jointing means 5 may be made exactly equal to the diameters of the jointing means. Both for this reason, and because of the action distributing the load over a large area of the nail plates, the use of the prefabricated joint of the invention allows the number of jointing means 5 in the joints 1 to be reduced to at least the half in most cases, and frequently to one third or one fourth compared to the number required when beams are conventionally connected directly by means of bolts. Also, the cross-area of the wooden beams 2 involved in the joint may be reduced by 15–45%, in most cases by approx. 30–40% compared to the cross-area of the beams used in a corresponding construction, when the joint is accomplished by conventionally joining the beams directly with bolts. This last effect is due to the fact that the structures must in most cases be dimensioned on the basis of the strength of the joint, so that other points of the structure will comprise excess material and superfluous strength.

Figure 9:
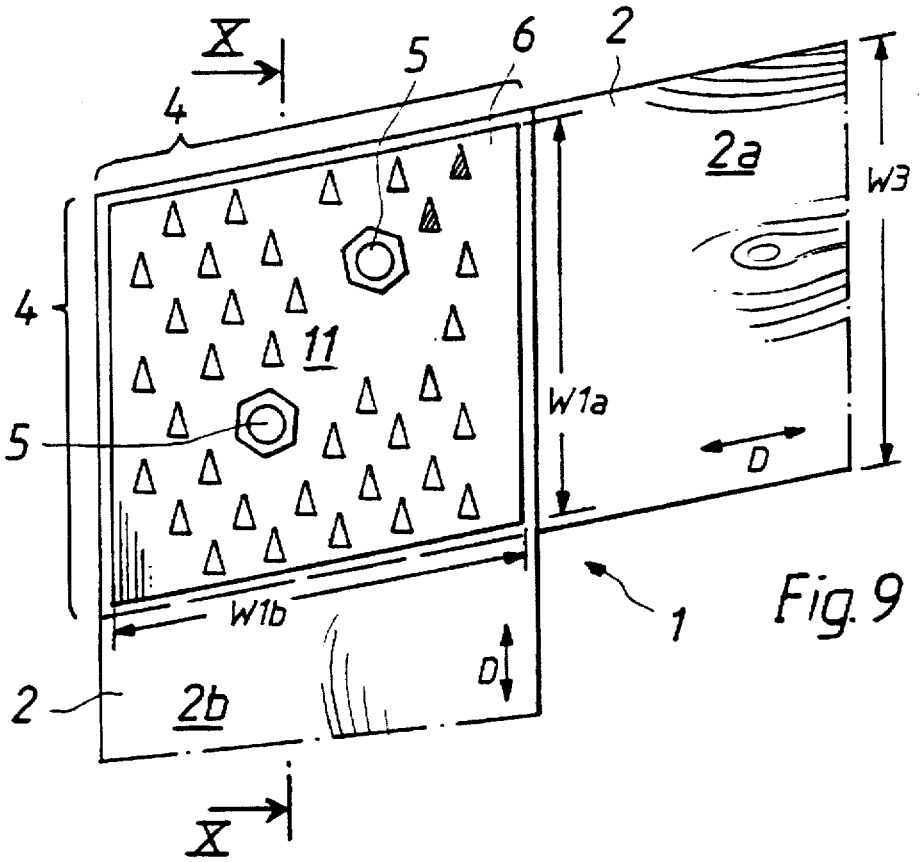
FIG. 9 shows a fourth finished angular joint, obtained by means of a fourth embodiment oft he joint design of the invention, viewed in the beam plane in direction IX of FIG. 10.
Figure 10:
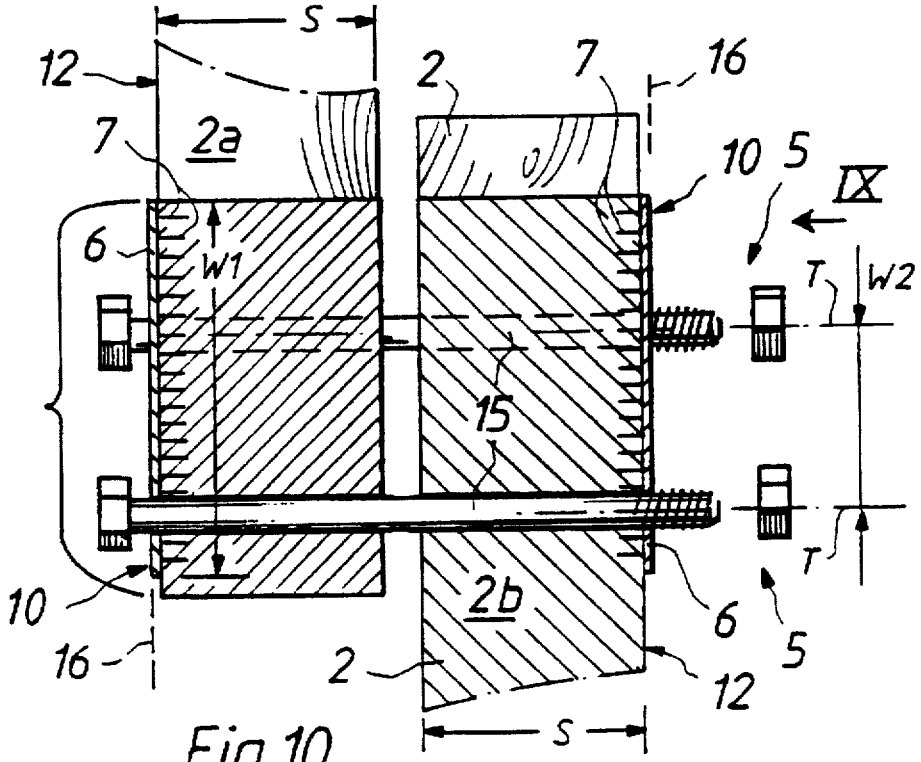
FIG. 10 shows the angular joint of FIG. 9 with the joint components separated but mutually positioned, as a cross-section along plane X—X in FIG. 9.

FIGS. 9 and 10 illustrate such a simple prefabricated joint structure of the invention, in which, on the joint portion 4 of each beam 2, a single-sided nail plate 6 has been placed against the outer surface 12 of the beam. This construction method is appropriate when the thickness S of the wood beams is relatively small, the force tending to alter the beam width W3 then also being small. In this case, the nail plates 6 are preferably placed in the joint 1 of two beams **2*a* and 2*b* on the beam surfaces facing away from each other, as shown in FIG. 10. The surfaces of the beams without nail plates will thus face each other and at the same time the nail plates 6 will form base plates for the bolt heads and the nuts. If, however, maximum strength is aimed at, and especially in cases where the beam thickness S is great, two single-sided nail plates 6 are preferably used in each beam, placed opposed to each other on the two opposite outer surfaces 12 of the beam. Such structures are illustrated in FIGS. 1–8 and 11–12. In all these cases, the nails plates are pressed against the opposed outer surfaces 12 of the beam on the joint portion 4 of one beam 2 so that the plate planes 16 of the nail plates will be parallel and perpendicular to the length T of the jointing means and thus to the depth of the holes 15, and the nails 7 in the nail plates 6**, embedded in the beam wood, will point at each other.

Figure 1:
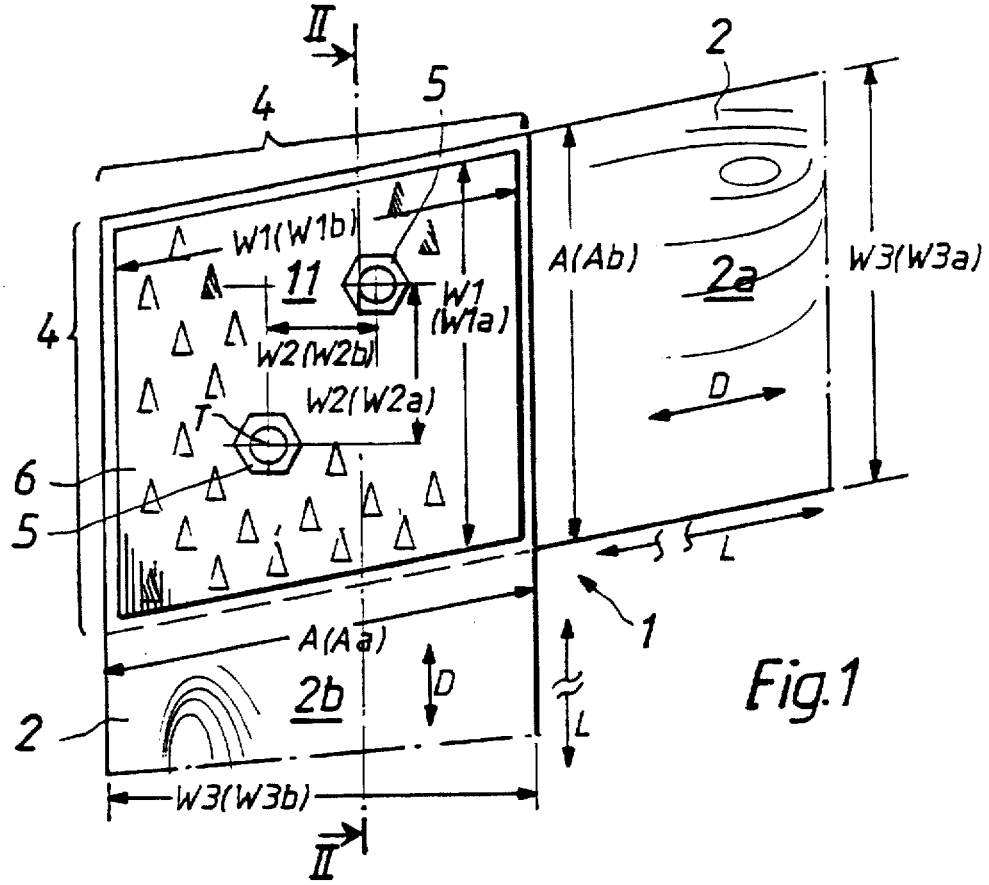
FIG. 1 shows a finished angular joint, achieved by means of one embodiment of the joint design of the invention, viewed in the beam plane in direction I in FIG. 2.
Figure 2:
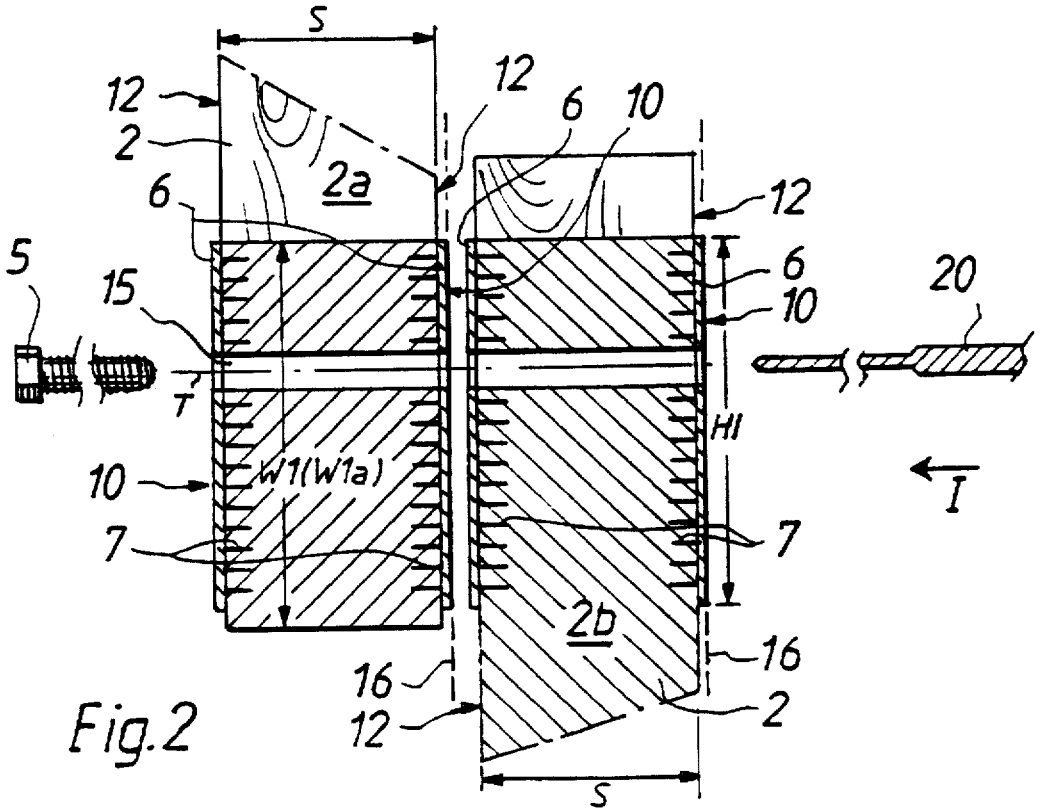
FIG. 2 shows the angular joint of FIG. 1 with the joint components separated but mutually poisitioned, as a cross-section along plane II—II in FIG. 1.

FIGS. 1 and 2 show a corresponding simple angle joint, accomplished by using the double-sided joint structure of the invention. The joint consists of two beams **2*a* and 2*b*, which cross each other, forming the joint area 4. In both of the beams 2*a* and 2*b*, on their opposite surfaces 12, nail plates 6 have been fixed, which have been dimensioned such that the width W1 of the nail plate in a direction perpendicular to the main grain D of the beam 2*a*, 2*b* is greater than the distance W2 between the two jointing means 5 and their holes 15** in this direction. Thus, the width W1*a* of the nail plates 6 fixed to the first beam **2*a*** is greater than the distance W2*a* between the bolts 5 in this direction, and in the illustrated embodiment, the width W1*a* of the nail plate in this direction is close to the width W3*a* of the beam **2*a*. Accordingly, the nail plates 6 of the second beam 2*b*** have a greater width W1*b* than the distance W2*b* between the bolts 5 in this direction, and in the illustrated embodiment, the width W1*b* of the nail plate is nearly equal to the width W3*b* of the beam **2*b***. Hence the width W1*a* of the nail plates in the first beam **2*a*** and the distances W2*a* between the beam holes are transverse to the main grain D of this beam and similarly, the width W1*b* of the nail plates in the second beam **2*b*** and the distances W2*b* between the bolts are transverse to the main grain D of this beam, so that transverse deformations in each beam **2*a* and 2*b* are efficiently prevented in accordance with the invention. This angle joint 1 is manufactured by first fixing nail plates 6 in the intended joint area 4 in each beam 2*a* and 2*b*, and subsequently the holes 15 for the jointing means 5 are perforated through the nail plates 6 and the beam wood material in a single operation by means of the drill 20. These holes 15 can be drilled at the correct point either by attaching the joint portion 4 of each beam 2*a* and 2*b* separately to a jig corresponding to the joint, and by drilling the holes 15 in this, or optionally by positioning the beams 2*a* and 2*b* into mutual positions, corresponding to the final joint, and by drilling holes 15 simultaneously in the two beams 2*a* and 2*b*. After this, the beams may be handled separately, taken to the mounting site and assembled into the final joint 1 by means of the bolts 5. In the light of the description above, the beam 2*a* and the second beam 2*b* may naturally comprise nail plates 6 of different shapes and dimensions, provided that the dimension defined in the transverse directions of the beams is carded out. In the embodiment of FIGS. 1 and 2 the nail plates in the two beams 2*a* and 2*b*** are preferably identical and the joint is fully symmetrical, so that the widths W1*a* and W1*b* of the nail plate are equal and the distances W2*a* and W2*b* between the jointing means holes 15 are equal. This is useful because the lengths of the joint portions relative to each beam are also equal, i.e. the length Aa of beam **2*a*** is equal to the length Ab of the joint portion of the second beam 2*b*. In this case, the lengths H1 of the nail plates 6 are also equal to the widths W1 and the longitudinal distances H2 between the jointing means holes are equal to the transverse distances W2, as in the embodiment of FIG. 3.

The embodiment in FIGS. 9 and 10 is identical to that of FIGS. 1 and 2 in every other respect, particularly with regard to the dimensioning described above, except that the embodiment of FIGS. 9 and 10 comprises one single nail plate 6 in the two beams 2*a*, 2*b*, as explained above in this application.

The embodiment of FIG. 3 is close to the embodiment of FIGS. 1 and 2 with regard to the general shape of the joint 1. Unlike the embodiment of FIGS. 1 and 2, the embodiment illustrated in this figure comprises two parallel beams 2*b*' and 2*b*" third beam 2*a* interconnected angularly to these, otherwise the joint has the same general shape as decribed above. In the embodiment of this figure each nail plate 6 is designed so as to consist of several smaller nail plate portions 6.1–6.4 on the respective outer surface of the beam, as illustrated at the joint portion 4 appearing at the top in the figure. On each of the three beams, on their two opposite outer surfaces, respectively four nail plates have been fitted as a circumference along the edges of the joint area 4, so that in each beam, the nails in respectively opposed nail plates, in this case nail plate portions, embedded in the wood, will point at each other. These four nail plate portions 6.1–6.4 are generally marked with the general reference 6. In this case, each beam 2*a* and 2*b* comprises several jointing means 5 and their holes 15 respectively in the direction transverse to the main grain D of the beam. In the joint area 4 of the beam 2*b*' appearing in the front in the figure, there are two rows of jointing means 5, i.e. in the nail plate portion 6.2 and the nail plate portion 6.4, and the overall width W1 of these two nail plates 6.2 and 6.4 in a direction perpendicular to the main grain D of this beam is greater than the total of the distances W2 between the bolt holes 15 in these nail plates. In the joint area of the beam 2*b*" parallel to this beam, there are nail plates identical to the nail plates of the beam 2*b*' described above, whose width W1 is also greater than the total of the distances W2 between the jointing means holes 15 in this direction. Thus the same jointing means 15, whose length T is perpendicular to the plane of these nail plates, pass through matching holes in these beams 2*b*'and 2*b*". In the joint area 4 of the beam 2*b* transverse to these beams there are similarly portions 6.5 and 6.7 of the nail plate 6 transverse to the main grain D of this beam, having a width W1 that is also greater than the total of the distances W2 between the jointing means holes 15 in this direction. In this joint the width W of the nail plates of the beam is not identical to the widths W1 of the nail plates in the second beams 2*b*, although the nail plates could be dimensioned in this manner. It is preferable to design the transverse nail plate portions in each respective beam so that they nearly extend over the width W3 of the beam, and the joint in FIG. 3 would thus imply that also the width W1 of the nail plate portions 6.2 and 6.4 would be close to the width W3*b* of the beam 2*b* concerned. However, the fact that the two edges of these nail plate portions are shorter by one jointing means distance W2, does not have any significant impact. The distances W2 and H2 between the jointing means holes 15 in various directions are preferably equal, so that the distances W2 between the nails in the transverse direction of the beam 2*a* are equal to the distances H2 between the jointing means holes 15 parallel to the grain in the beams 2*b*' and 2*b*". Accordingly, the distances H2 between the jointing means holes 15 parallel to the grain D in beam 2*b* are equal to the distances W2 between the jointing means holes transverse to the grain in the beams 2*b*' and 2*b*". This configuration allows the jointing means 5 to fit through the holes 15 in the direction of the grains D of the two beams and in directions perpendicular to these grains. The lengths H1 of the nail plates are of the same order as their widths W1, which means that the joint structures of this joint are also at least nearly symmetrical. Since this joint 1 comprises several jointing means 5, such as bolts, both in the direction of the beam grains D over the entire joint portion length Aa and Ab and in a direction perpendicular to these over the entire beam widths W3*a* and W3*b*, a particularly strong joint is provided. There are no nail plates or bolts or the like in the central area of the joint area 4, but then this area is not crucial in terms of the strength of the joint, if the beams 2 are firmly joined in accordance with the invention in the lateral areas of the joint area.

Figure 4:
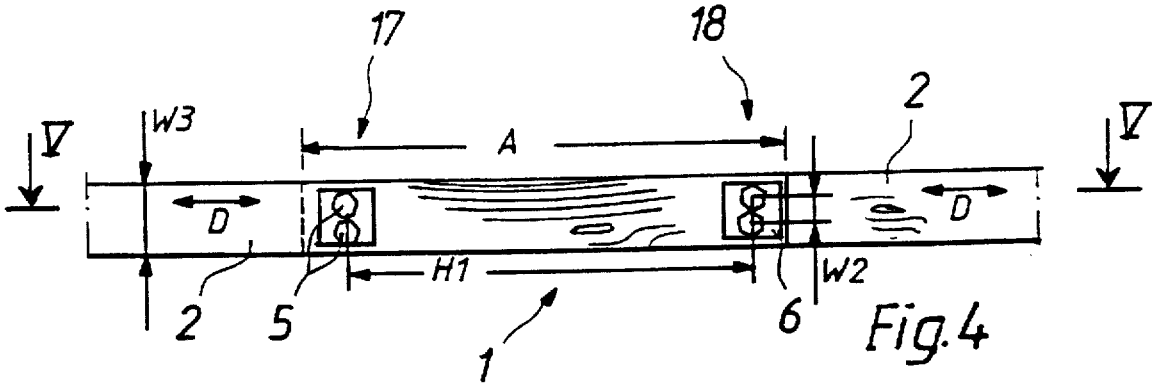
FIG. 4 shows a finished scarf joint, obtained by means of a third embodiment of the joint design of the invention, viewed in the beam plane in direction IV in FIG. 5.
Figure 5:
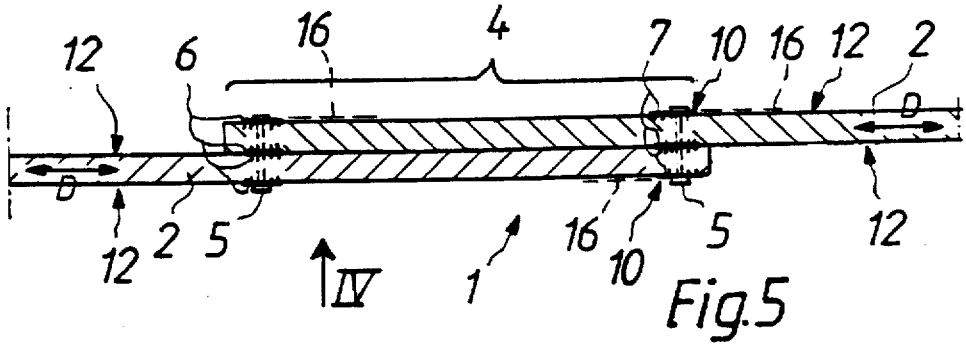
FIG. 5 shows the scarf joint of FIG. 4 as a longitudinal section along plane V—V of FIG. 4.
Figure 6:
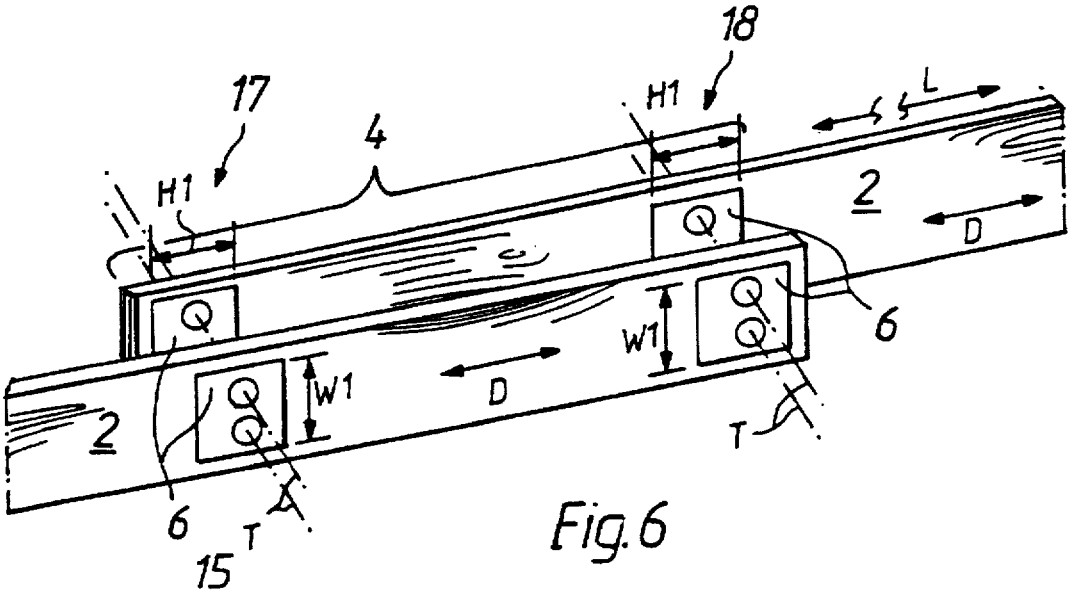
FIG. 6 shows the scarf joint of FIGS. 4 and 5 as an axonometric exploded view.

FIGS. 4–6 show a fairly simple scarf joint for wooden beams 2, in which there are jointing means 5 at two points 17, 18 of the length A of the joint portion 4 in a direction perpendicular to the main grain D of the beams. As described above, nail plates 6 are fitted at these two points 17, 18 and on both surfaces 12 of the two beams 2 and jointing means holes 15 have been perforated in these nail plates at the two points so that the distance W2 between the holes 15 in a direction transverse to the grain D is essentially smaller than the width W1 of the nail plate in this direction. The distance H1 between the jointing means 5 in the longitudinal direction L of the beams is relatively great. Such a joint is stiff and resists pulling, compression and bending extremely well, and it is manufactured in the same way as the two angle joints described above. The manufacture comprises hitting the nail plates 6 at preselected points in the finished beams, drilling holes 15 either in a jig or preassembling these two beams and subsequently drilling holes, and alter this the beams can be transported separately to the mounting site and assembled by means of the jointing means 5.

FIGS. 7 and 8 illustrate an angle joint, which differs essentially from the angle joint in FIGS. 1–3. Here the two beams 2*a* and 2*b* are fitted to abut at point 14. In the two beams 2*a*, 2*b* transverse nail plates 6 have been placed parallel to their grain D and spaced by a distance H2, their width W1 transverse to the grain being essentially greater than the distances W2 between the holes 15 for the jointing means 5 in the same direction. In this case, five jointing means 5 and accordingly five holes 15 have been fitted transversely in each beam and each nail plate 6. Also in this case the width W1 of the nail plates is close to the beam width W3. In addition to this, the joint 1 comprises plates 8 placed in the same plane on either side of the abutting beams 2*a* and 2*b*, the plates being made of wood also in this case, and nail plates 6 having been fitted on their two outer surfaces 13 in the same manner and at the same points as in the actual beams 2*a* and 2*b* to be joined. The jointing means holes 15 pass both through these plates 8, the nail plates 6 attached to these and the nail plates 6 attached to the beams 2*a* and 2*b* and their surfaces, and the jointing means 5 are pushed through all of these, forming the finished joint. The plates 8 may also be metal plates, which of course do not require any nail plates, but the beams proper 2*a* and 2*b* always require nail plates 6. If the plates 8 are symmetrically cross-glued veneers, it is useful to fit nail plates on their surfaces, however, the dimensioning of the nail plates relative to the measures of the plates 8 is not critical, given that such symmetrically cross-glued veneers have no distinct main grain nor a direction perpendicular to this. The dimensional variations in cross-glued veneers are generally relatively small, and do not always call for restriction. However, it is usually advantageous to restrict also the dimensional variations in symmetrically cross-glued veneers in the same direction or directions in which the dimensional variation of the beam 2a or 2b to be connected has been restricted. In case the plates 8 consists of a mainly wooden beam or similar having a distinct main grain and a direction transverse to this, the nail plates to be attached to this plate 8 must meet the requirements posed by the invention with regard these. Consequently, this joint also comprises jointing means 5 also in the direction of the main grain D of the beams spaced by a distance H2. This joint has great stiffness and a high joining effect.

Figure 12:
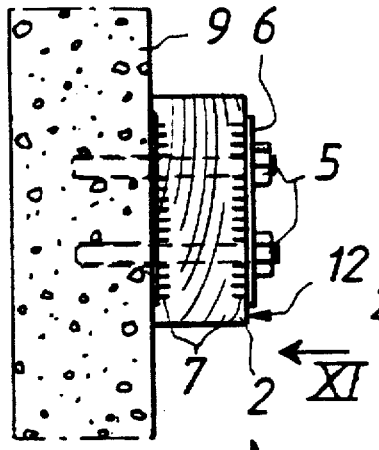
FIG. 12 shows the joint of FIG. 10 as a cross-section along plane XII—XII of FIG. 11.

FIGS. 11 and 12 illustrate a prefabricated joint structure, in which the wooden beam 2 has been fixed to a solid construction 9. In this case the solid construction 9 comprises stationary jointing means 5, spaced both by mutual distances W2 transverse to the beam and mutual distances H2 in the longitudinal direction of the beam. Nail plates 6 have been fixed on either side of the beam 2, and jointing means holes 15 have been drilled in the beam by using a jig, and after these operations the beam is ready to be conveyed to the mounting site, to be positioned by means of jointing means 5 and to be fixed by means of these. Here also, the width W1 of the nail plate 6 is essentially greater than the distance W2 between the holes 15 for the jointing means 5 in a direction transverse to the beam grain D.

Figure 13:
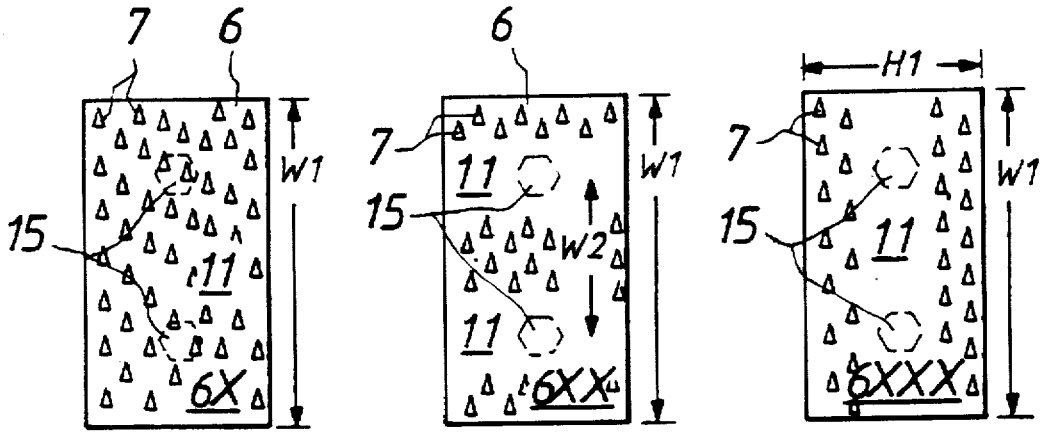
FIG. 13 shows three different embodiments of the nail plates used in the prefabricated joint design of the invention in a direction perpendicular to their plate plane.

FIG. 13 illustrates three typical ways of arranging the nails in the nail plates for use in the prefabricated joint structure of the invention. The nail plate 6x comprises nails 7 evenly distributed over the entire surface of the nail plate 6. The holes 15 for the jointing means are then perforated regardless of these nails 7, in other words through the nail plate and the beam also at the point of the nails. The nails provided at the hole 15 will then of course disappear. Nailfree areas 11 may also be provided in the nail plates. In the nail plate 6xx in FIG. 13 two nailfree strips 11 have been formed, spaced by the distance W1 parallel to the nail plate width. These nailfree strips 11 will in this case be parallel to the beam gain and their distance is typically equal to the distance W2 between the jointing means in this direction. The jointing means holes 15 can be easily drilled in such a nailfree area. The nailfree area 11 may also be disposed to run in the width direction W1 of the nail plate 6 which will be transverse to the gain D, as illustrated in nail plate 6xxx in FIG. 13. In this case the distance between the jointing means holes 15 may be chosen irrespective of the nail plate, so as to be adequate for the joint concerned. All the types of nail plates shown in FIG. 13 can be manufactured in a continuous process as a web, which can be cut into nail plates with the desired length H1 respectively W1. FIGS. 1 and 9 show nail plates 6, comprising a nailfree area 11 in the centre and nails disposed at least nearly identically at all edges. Such nail plates can only be manufactured one by one, and hence they are somewhat more expensive than the ones produced in a continuous process as described above. The surfaces facing away from the nails 7 in the nail plates 6 are preferably smooth, so that they can be pressed against each other, as required in joints connecting two or more beams, the nail plates having been pressed to both the outer surfaces 12 of the wooden beams 2. At the same time, this smooth surface enables the jointing means holes 15 to be perforated at any point of the nail plate area whenever necessary. In addition, such a smooth nail plate surface acts as a base plate for the bolt head and the nut, so that no small, easily lost parts are needed for the assembly of the prefabricated joint structure of the invention, and on the whole, it requires fewer components than previously known joints.

I claim:

1. A prefabricated joint structure, including a substantially wooden component having a main grain, ends, and opposite sides, for connecting the component with an other structure, the joint structure comprising:

at least first and second component fastener plates fastened to one of the opposite sides of the component, the first and second component fastener plates extending along the surface of the component but not substantially beyond the ends of the component;

a plurality of fasteners extending from each of the first and second component fastener plates and embedded in the component;

a plurality of jointing holes formed through the component fastener plates and the component, the jointing holes extending substantially parallel to the fasteners, each of the plurality of jointing holes extending through one of the component fastener plates and the component, the jointing holes being formed after the component fastener plates are fastened to the component in order to retain dimensional accuracy of the jointing holes through the component fastener plates and the component, the plurality of jointing holes comprising at least two transverse jointing holes formed through at least one of the component fastener plates, the transverse jointing holes positioned spaced apart at least in a direction substantially transverse of the component main grain, and at least two longitudinal jointing holes spaced apart in at least a direction substantially parallel to the component main grain; and jointing means receivable in the jointing holes.

2. The prefabricated joint structure of claim 1, wherein the longitudinal jointing holes are formed in different component fastener plates.

3. The prefabricated joint structure of claim 1 for connecting the component with the other structure, the other structure being substantially wooden and having a structure main grain, wherein the longitudinal jointing holes are positioned to be, upon assembly with the other structure, spaced apart in at least a direction substantially transverse of the structure main grain.

4. A prefabricated joint structure, including a substantially wooden component having a main grain and opposite sides, for connecting the component with another structure, the joint structure comprising:

at least first and second component fastener plates fastened to the component on one of the opposite sides, the component fastener plates having a plurality of fasteners extending therefrom and embedded in the component;

a plurality of jointing holes, including at least two transverse jointing holes formed through the first component fastener plate and the component, and at least two longitudinal jointing holes formed through one of the first and second fastener plates and through the component, the jointing holes extending substantially parallel to the fasteners of the component fastener plates, the jointing holes being formed after the component fastener plates are fastened to the component in order to retain dimensional accuracy of the jointing holes through the component fastener plates and the component, the transverse jointing holes positioned spaced apart at least in a direction substantially transverse of the component main grain, the longitudinal jointing holes spaced apart in at least a direction substantially parallel to the component main grain; and jointing means receivable in the jointing holes.

5. The prefabricated joint structure of claim 4, wherein the longitudinal jointing holes are formed in different component fastener plates.

6. The prefabricated joint structure of claim 4 for connecting the component with the structure, the structure being substantially wooden and having a structure main grain, wherein the longitudinal joint holes are positioned to be, upon assembly with the structure, spaced apart in at least a direction substantially transverse of the structure main grain.

* * * * *

UNITED STATES PATENT AND TRADEMARK OFFICE

CERTIFICATE OF CORRECTION

PATENT NO. : 5,720,568

DATED : February 24, 1998

INVENTOR(S) : Matti Kairi

It is certified that error appears in the above-identified patent and that said Letters Patent is hereby corrected as shown below:

Col. 6, line 7, "similarjointing" should read --similar jointing--.
Col. 6, line 15, "gain" should read --grain--.
Col. 6, line 28, "gain" should read --grain--.
Col. 6, line 42, "gain" should read --grain--.
Col. 5, line 35, "gain" should read --grain--.
Col. 5, line 38, "gain" should read --grain--.
Col. 6, line 47, "gain" should read --grain--.
Col. 6, line 54, "gain" should read --grain--.
Col. 6, line 62, "gain" should read --grain--.
Col. 8, line 60, "carded" should read --carried--.
Col. 11, line 41, "gain" should read --grain--.
Col. 11, line 46, "gain" should read --grain--.
Column 5, line 37, "gain" should read --grain--.
Column 5, line 38, "gain" should read --grain--

Signed and Sealed this

Sixteenth Day of February, 1999

*Attest:*

*Attesting Officer*

*Acting Commissioner of Patents and Trademarks*